US005346746A

United States Patent [19]

Abrams

[11] Patent Number: 5,346,746

[45] Date of Patent: Sep. 13, 1994

[54] TRANSFERS

[75] Inventor: Louis B. Abrams, St. Louis, Mo.

[73] Assignee: High Voltage Graphics, Inc., Fort Collins, Colo.

[21] Appl. No.: 26,005

[22] Filed: Mar. 4, 1993

Related U.S. Application Data

[62] Division of Ser. No. 676,377, Mar. 28, 1991, Pat. No. 5,207,851.

[51] Int. Cl.[5] ..... B32B 9/00

[52] U.S. Cl. ..... 428/195; 428/88; 428/90; 428/92; 428/96; 428/97

[58] Field of Search ..... 428/195, 86, 96, 88, 428/43, 90, 95, 283, 372, 207, 92; 156/72, 230

[56] References Cited

U.S. PATENT DOCUMENTS

| | | | |
|---|---|---|---|
| 3,775,205 | 11/1973 | Hermann et al. | 156/72 |
| 4,018,956 | 4/1977 | Casey | 428/86 |
| 4,142,929 | 3/1979 | Otomine et al. | 156/72 |
| 4,574,018 | 3/1986 | Masuda et al. | 156/72 |
| 4,652,478 | 3/1987 | Maii | 428/43 |
| 4,681,791 | 1/1987 | Shibahashi et al. | 428/96 |
| 4,810,549 | 3/1989 | Abrams et al. | 428/88 |
| 5,047,103 | 9/1991 | Abrams et al. | 156/72 |
| 5,207,851 | 5/1993 | Abrams et al. | 156/230 |

*Primary Examiner*—Patrick J. Ryan
*Assistant Examiner*—Patrick R. Jewik
*Attorney, Agent, or Firm*—Paul M. Denk

[57] ABSTRACT

A combination flock and other material transfer. The flock has an open interior section. The other material, such as twill, is die cut greater than the opening of the interior section of the flock but less than the outside dimensions of the flock design. The unit is applied to a garment with a hot melt adhesive which seals the flock to the twill and the edges of the flock and the twill to the garment.

3 Claims, 1 Drawing Sheet

TRANSFERS

This is a divisional application of the application of the same inventor filed in the United States Patent Office on Mar. 28, 1991 under Ser. No. 07/676,377, now U.S. Pat. No. 5,207,851

BACKGROUND OF THE INVENTION

I. Field of the Invention

The invention generally relates to a method of manufacturing combination flock transfers. Specifically, the invention is directed to transfers that are substitutable and/or enhancements for conventional sewn twill decorative designs. More particularly, the present invention is directed to a product and method that combines twill or other material with flock to produce a decorative product that can be used as a substitute for the conventional sewn-on product.

II. Description of the Prior Art

Sewn twill is usually employed as a means of team lettering athletic uniforms and accessories. It can be very expensive to use sewn twill in decorative applications due to the cost of applying the letters or design to the garment. Each letter must be cut, placed in position and sewn to the garment which is very time consuming and thus expensive. Most importantly, it must be sewn at the edges to avoid fraying during washing.

A sewn multicolor twill design comprises at least two members. As shown in FIG. 1, the sewn twill unit can have an outer member 2 and an inner member 4. Each of the members can be precisely die cut so that the outer member 2 forms an outline for the inner member 4. The inner member 4 is positioned over the outer member 2 and temporarily heat sealed together (tacked) to maintain their alignment.

The letters 6 are then assembled on the garment 8 and temporarily heat sealed (tacked) to maintain their position. The edge of inner member 4 is then hand sewn to the outer member 2. This is followed by the sewing of the edge of outer member 2 to the garment 8. This process must be performed on each letter individually. Instead of sewing the letter it is possible to use an adhesive to affix the letter to the garment.

As is apparent from the preceding the sewn twill process has a number of limitations which make it very expensive and difficult to employ. The process is very labor intensive which makes it must more expensive than other forms of lettering. Not only is it labor intensive but the process requires highly skilled sewers to sew the letters to the garments. Thus, the cost of garments utilizing sewn twill can be prohibitively high which can limit the use of sewn twill in moderately priced goods.

What is needed is an alternative to sewn twill which provides a similar appearance without being expensive to either produce or apply to a garment. It is important that the alternative be easy to apply without the necessity of highly skilled sewers but which can be applied in factories or stores with general technicians using conventional transfer heat presses. It is these objects which the present invention fulfills.

SUMMARY OF THE INVENTION

A flock and decorative material transfer wherein the flock design has an open interior section. The decorative material design is dimensionally greater than flock's open interior section and less than the flock's outside dimension.

Also, a method of making said transfer which comprises forming a flock transfer having an open interior section. Bonding a decorative material to the transfer whose surface is dimensionally greater than the dimensions of the open interior section of the flock and less than the outside dimensions of the flock.

DESCRIPTION OF THE PREFERRED EMBODIMENTS

The manufacture of decorative flock transfers is well known. These products and their method of manufacture are described in the following U.S. Pat. Nos. 3,793,050; 4,142,929; 4,292,100; and 4,810,549. Each of these patents are incorporated by reference herein.

Figure 1:
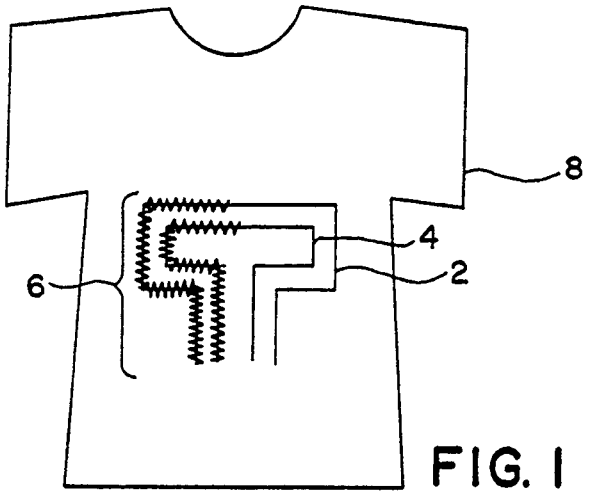
FIG. 1 illustrates the application of a twill decorative product to a garment.
Figure 2:
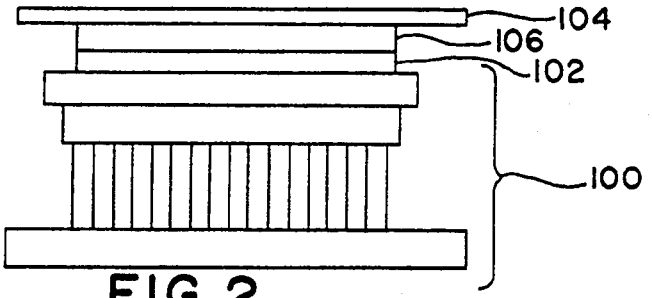
FIG. 2 is the transfer of the invention.

As shown in FIG. 2, the present invention departs from conventional flock transfer technology to produce a sewn twill substitute. The first step of the invention is to make an outline of each letter 100 using conventional flock transfer technology. A sheet of twill 102 is coated with a hot melt adhesive 106. The twill 102 and hot melt 106 is attached to a paper liner 104 with an adhesive. This step is optional.

The twill 102 is then die cut slightly smaller than the flock 100 so that the flock transfer 100 overlays the edges of the twill 102. The excess twill is "weeded out". The twill and the flock are placed together and heated for several seconds under pressure at a temperature of approximately 300–350 degrees F. The paper liner 104 may then pulled off the unit. The unit can be applied to the garment 104 in the same manner as any other heat seal applique or transfer.

In summary, the steps for making the transfers of the invention involve making the flock transfer which comprise:

1. flocking a design on to a paper substrate having a release adhesive, said design having an open inner surface area; and 2. applying a binder and hot melt adhesive to the flock design.

The twill or decorative portion of the transfer is made using the following steps:

a) applying a hot melt adhesive to a paper substrate coated with a release adhesive;

b) with the use of heat bonding the twill to the hot melt layer;

c) die cutting the twill so that it is smaller than the outside dimensions of the flock; and d) weeding out the excess twill.

The two components are then combined in the following steps:

1. the release paper is removed from the twill side exposing the hot melt adhesive;

2. the transfer is placed on the garment with the hot melt of the twill component and the hot melt of the edges of the flock component adjacent to the garment; and 3. heat is applied which activates the hot melt adhesive to activate the adhesives and thus bind the transfer to garment; and 4. the release sheet protecting the flock layer is then removed.

Flocking methodology is well known. The method of forming the flock component, the twill component or their application to a garment is not critical per se. It is the combination which forms the basis of the invention.

The advantage to using a combination flock and twill is that the flock functions to seal the edges of the twill. Thus, sewing is unnecessary in the present invention. The guide edges of the paper are used to align the twill and flock sheets. No special expertise is required to apply the transfer to the garment. It is also feasible to bind the twill to the flock and the transfer to the garment in one step instead of two as previously described.

The flock/twill transfer gives substantially the same appearance as the traditional sewn twill lettering at only a fraction of the cost. It provides a more dimensional, interesting combination of two different textures. Materials other than twill can be used in the performing of the invention i.e. knits or plastics etc. Most importantly, unlike conventional twill lettering where one letter is placed on a garment at a time, utilizing the method of the invention the entire name can be placed on a garment with a single transfer which avoids alignment problems.

Figure 3:
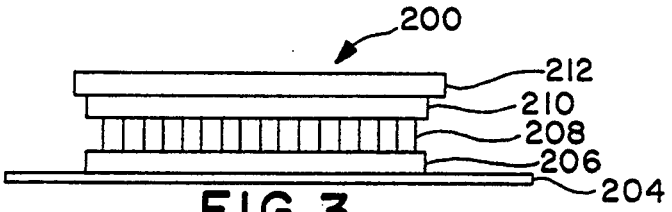
FIG. 3 is a conventional flock transfer.

As shown in FIG. 3, the flock transfer 200 of the present invention comprises a release sheet 204, such as paper or polyester film, to which a conventional flock transfer release adhesive 206, usually acrylic, and/or urethane is applied. A preferred release adhesive is commercially available as LR 100, manufactured by Societe D'Enduction et de Flockage. The release sheet, however, may be any material which can be suitably used with the adhesive which should be selected to effect temporary adhesion of the flock fibers. Although paper, such as dimensionally stable, processed paper, and plastic films are preferred, resin sheets and metal foils may also be employed. Depending on the desired effect and the sheet materials employed, the release sheet may be transparent, translucent or opaque, but is preferably transparent.

The release adhesive 206 may be applied in the reverse of a desired pattern, that is, a pattern which corresponds to the overall image which is to be flocked. Preferably, however, the release adhesive may be applied without regard to the overall design desired, for example by applying the released adhesive with rollers or spraying the release sheet with a coating of the release adhesive, particularly when the batches of flock having different fiber lengths and/or precolored flocks are sequentially applied to the adhesives, as discussed in more detail hereinbelow. The release adhesive may be applied in the form of a solution or emulsion, such as a resin or a copolymer, such as polyvinyl acetate, polyvinyl alcohol, polyvinly chloride, polyvinyl butyral, acrylic resin, polyurethane, polyester, polyamides, cellulose derivatives, rubber derivatives, starch, casein, dextrin, gum arabic, carboxymethyl cellulose, resin, or compositions containing two or more of these ingredients.

The flock 208 is preferably composed of precolored fibers that are greater than 0.5 mm in length, which may be referred to herein as flock fibers. The flock may be rayon, and other types of conductive material, such as nylon, polyamide, polyester and similar synthetic fibers, with nylon being preferred, and is applied to the adhesive 206, such as activated adhesive, by electrostatic processes, spraying, or by gravity, such as sprinkling or vibrating the flock onto the surface of the base sheet provided with the release adhesive, with electrostatic flocking being preferred.

In general, conventional electrostatic flocking utilizes a field of static electricity to orient fibers and promote their perpendicular alignment. This technique has been found to be particularly suitable for flocking with longer fibers in accordance with the present invention. In a method of electrodeposition used for purposes of the present invention an adhesive-coated release sheet is passed between the potentials of a high voltage electrostatic field. An electrode is utilized to give the flock a charge. The charged fibers become aligned with the electrical field lines of force. The ground potential is formed by the release sheet and/or the grounded parts of the machine. The flock is thus attracted to the adhesive where it becomes embedded. Most fibers adhering to the adhesive-coated surface are perpendicular to it, thus resulting in a dense pile finish. Inasmuch as it is the nature of the field to align the fibers perpendicular to a surface, electrostatic flocking permits substantially any shape object to be flocked, may be used for a variety of objects.

Figure 4:
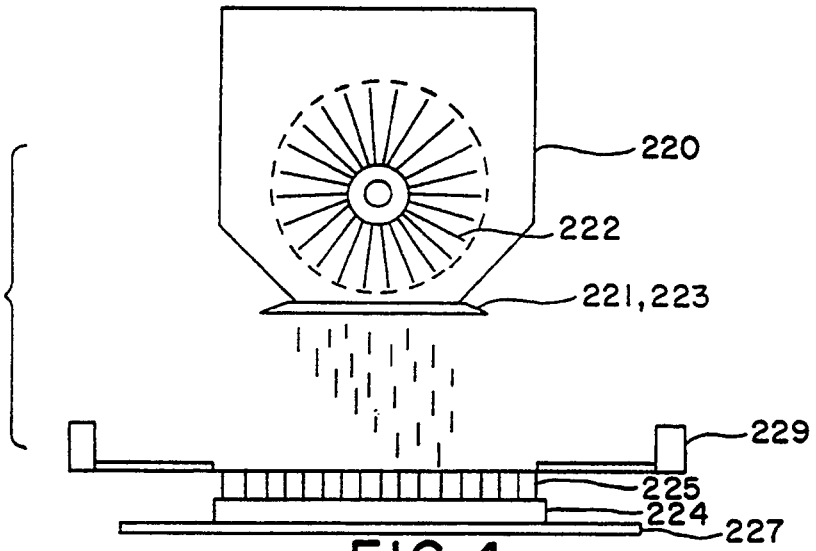
FIG. 4 illustrates the preferred method of making a flock transfer.

More specifically, referred to FIG. 4, flock fibers are dosed or dispensed from a hopper or box 220 by being physically pushed through a dispensing screen 221, which is preferably made of metallic mesh, by means of a rotating dosing brush 222, down into the electrostatic field and through barrier 229. The barrier 229 has an open section corresponding to a predetermined pattern of flock to be passed therethrough. The barrier 229, which is preferably a mesh screen, may also be referred to herein as the image screen. As shown, the image screen is located between the dispensing screen 221 of the hopper and substrate material 227. Preferably, the image screen is positioned closely adjacent the substrate material and more preferably is spaced from the substrate material by a distance which is about equal to the length of flock being applied to the substrate, and more preferably by a distance of about 110% of the length of the flock. In the most preferred instance, the binding adhesive is preferably applied to the substrate material to a thickness equal to less than about 10% of the length of the flock. The metallic dosing screen is connected to a high voltage source and is itself the high voltage electrode 223 giving the flock fibers a charge, either positive or negative. The charged fibers are then attracted to the counter potential, i.e., the screen and adhesive 224 below the screen. Fibers 225 are propelled by electrostatic counter potential attraction toward the grounded electrode, and they either then contact the screen and reverse polarity and are then propelled again towards the electrode screen or, if they are propelled into the adhesive 224, they become permanently lodged in it and remain there, eventually forming the flock coating on the adhesive coated fabric or substrate material 227. In accordance with the present invention, the flock becomes polarized, taking on both the charge of the electrode on one end and the counter potential charge on the other so it is no longer oscillating in the electrostatic field.

The resultant flock has an electrically conductive chemical finish coating to enable it to become charged as well as to enable it to continually change charges back and forth from positive to negative thousands of times per minute. Thus, the flock oscillates back and forth between the electrode, i.e., the dosing screen, and the ground, i.e., image screen until it eventually finds a permanent location in the adhesive. The amount of flock therefore dosed into the electrostatic field is adjusted to be roughly equal to the amount which is taken out of the field or used by the printed adhesive, to avoid overdosing or crowding of the fibers in the field which may block the image screen or simply waste the flock. Up to 100,000 volts is used with very low amps, e.g., a maximum of 2000 microamps with about 40,000 volts being preferred. For textile applications, 1 millimeter nylon flock with 3.3 Dtex (diameter) is preferred.

Referring back to FIGS. 3 and 4, the flock 208 of the flock covered release sheet 204 is then coated with a binder adhesive 210, such as a water based acrylic, which binds the flock into a unit and is a barrier for the hot melt. Preferably the binding adhesive is applied in the form of a solution or emulsion. The binder adhesive preferably contains a resin, such as polyvinyl chloride, polyvinyl acetate, polyurethane, polyester, polyamide, and acrylic resin, and preferably the previously mentioned water based acrylic. A preferred binder adhesive is commercially available as Tubitrans Bond manufactured by Chemische Fabrik Tubitrans R. Beitlich GmbH & Co. Turbitrans Bond is an acrylic dispersion which is cross-linkable at higher temperatures in the form of a high viscosity, white paste. The acrylic dispersion has viscosity of cp. 4.5–4.6 measured with Contraves Viscometer, type Eppprecht, Instrument and a pH of about 7–8. This acrylic resin dispersion may be mixed with Tubitrans Fix 2 and optionally further with a colormatch dyestuff. A preferred binder adhesive, therefore, would be 100 parts Tubitrans Bond, 8 parts Tubitrans Fix 2, and 0–3 parts colormatch dyestuff. The binder adhesive 210 may contain additional or supplemental adhesives, such as a hot melt adhesive, usually a granular polyester or nylon, for binding the transfer to a substrate.

Alternatively, the hot melt adhesive 212, may form a separate layer. The use of separate hot melt layers is preferable. In addition, other heat sensitive adhesives, such a polyvinyl chloride, thermoplastic acrylic resin, polyethylene, polyamide, polyurethane, paraffin and rubber derivative may be used for this purpose, with polyurethane being preferred.

In accordance with the present invention the transfers may be applied to a surface area of any type of article, but preferably a garment or piece of wearing apparel, to which it is desired to affix or imprint a word, design, logo, emblem or other sign or symbol, particularly shirts, jerseys, jackets, pants, shorts and caps, such as those designed to be worn during athletic activities, e.g., U.S. baseball uniforms. Also instead of twill polyvinyl chloride may be used as the combination decorative material. Under such circumstances radio frequency energy instead of heat is preferable as a means of binding.

I claim:

1. A combination decorative transfer for clothing having a flock component with at least one open interior cutout section along its width and length, and a second material which is dimensionally slightly greater than the open interior of the flock to furnish some overlap therewith when applied in overlying relationship thereto, said second material having dimensions less than the overall width and length dimension of the flock component, said flock component being positioned over the second material in such a manner that the flock component overlaps the second material and the second material is solely visible through the open interior section of the flock component, said flock thickness being greater than 0.5 mm, the second material being a twill, an adhesive bonding said twill around its periphery to the said overlying flock component, a hot melt adhesive provided rearwardly upon both said twill and flock component to adhere the transfer to any clothing upon the application of heat and pressure frontally applied to the said transfer during its application, a release adhesive applied forwardly to the said transfer, and a release sheet applied to said release adhesive and capable of being removed after the transfer is applied through the application of the heat and pressure to the transfer during its application to clothing.

2. The transfer of claim 1 wherein the second material is polyvinylchloride.

3. The transfer of claim 1 wherein the transfer forms compound letters or numbers composed of an outer flock component and an inner disposed twill.

* * * * *